US006851395B2

(12) United States Patent
Knaus

(10) Patent No.: US 6,851,395 B2
(45) Date of Patent: Feb. 8, 2005

(54) HEAT TRAP WITH NON-ROTATING SEALING MEMBER

(75) Inventor: Jason Knaus, Euclid, OH (US)

(73) Assignee: Perfection Corporation, Madison, OH (US)

( * ) Notice: Subject to any disclaimer, the term of this patent is extended or adjusted under 35 U.S.C. 154(b) by 0 days.

(21) Appl. No.: 10/644,201

(22) Filed: Aug. 20, 2003

(65) Prior Publication Data

US 2004/0055544 A1 Mar. 25, 2004

Related U.S. Application Data

(60) Provisional application No. 60/411,912, filed on Sep. 19, 2002.

(51) Int. Cl.[7] ..... F22B 5/04
(52) U.S. Cl. ..... 122/14.31
(58) Field of Search ..... 122/14.31, 14.3

(56) References Cited

U.S. PATENT DOCUMENTS

| | | | | |
|---|---|---|---|---|
| 1,173,620 A | | 2/1916 | Thompson | |
| 1,365,856 A | | 1/1921 | Sandlin | |
| 3,055,086 A | | 9/1962 | Hoganson | |
| 3,059,667 A | | 10/1962 | Coceano | |
| 3,796,230 A | | 3/1974 | Meripol | |
| 4,286,573 A | | 9/1981 | Nickel | |
| 4,465,102 A | | 8/1984 | Rupp | |
| 4,633,853 A | | 1/1987 | Prill et al. | |
| 4,741,679 A | | 5/1988 | Blassingame | |
| 4,964,394 A | | 10/1990 | Threatt | |
| 5,277,171 A | | 1/1994 | Lannes | |
| 5,577,491 A | * | 11/1996 | Lewis | 122/14.3 |
| 5,620,021 A | * | 4/1997 | Hugo | 137/337 |
| 5,794,661 A | | 8/1998 | Natalizia | |
| 6,269,780 B1 | | 8/2001 | Hughes | |
| 6,302,063 B1 | | 10/2001 | Schimmeyer | |

* cited by examiner

*Primary Examiner*—Gregory Wilson
(74) *Attorney, Agent, or Firm*—Fay, Sharpe, Fagan, Minnich & McKee, LLP

(57) ABSTRACT

A heat trap assembly for a hot water tank includes a housing and a sealing member disposed in the housing. The sealing member includes a first portion that is adapted to restrict rotational movement of the sealing member in at least two perpendicular axes. The sealing member includes a second portion that is adapted to restrict rotational movement in a third axis perpendicular to both of the at least two perpendicular axes.

20 Claims, 4 Drawing Sheets

HEAT TRAP WITH NON-ROTATING SEALING MEMBER

This application claims priority under 35 U.S.C. 119(e) from provisional application Ser. No. 60/411,912 filed Sep. 19, 2002, which is incorporated by reference.

BACKGROUND OF THE INVENTION

This invention relates to a heat trap assembly for hot water tanks. More specifically, this invention relates to a heat trap assembly including a non-rotating sealing member that is received in the heat trap assembly. It is also appreciated that the heat trap assembly is also amenable to other applications.

Referring to FIG. 1, a hot water heater assembly 10 generally includes a tank 12 including a heating element (not shown), a cold water inlet pipe 14 and a hot water outlet pipe 16. As the hot water is turned on, for example the hot water spigot in a household, hot water exits through the hot water outlet pipe 16 while cold water flows through the cold water inlet 14 into the tank 12. The amount of hot water leaving the tank equals the amount of cold water replaced and heated in the tank.

Considerable heat is lost through the water inlet and outlet piping of a water heater. The heat loss is due primarily to thermal circulation and not as a result of conduction through the piping itself.

FIG. 2 displays a prior art attempt to control the heat lost through the water inlet and the water outlet piping of the water heater. A prior art cold water inlet heat trap assembly 20 includes a nipple 22, a seat 24, a cage 26, and a ball 28. The nipple 22 is received in the inlet 30 of the tank 12 and also received in the outlet 32 of the cold water inlet pipe 14. The nipple provides the housing for the heat trap assembly 20. The seat 24 is formed inside the nipple. The seat includes an opening having a diameter smaller than the diameter of the ball 28. The cage 26 is a cage-like structure that traps the ball inside the nipple as water from the inlet pipe 14 flows through the nipple 22 into the tank 12. The ball 28 has a specific gravity less than 1.0 so that when no water is flowing through the cold water inlet pipe and the nipple into the tank the ball floats up to cover the opening at the seat.

In use, the hot water is turned on somewhere in the household, or wherever the tank is located. Almost simultaneously, hot water exits the hot water tank 12 through the hot water outlet pipe 16 and cold water enters the tank 12 through cold water inlet pipe 14. As cold water flows through the nipple 22, the water dislodges the ball 28 from the seat 24 and the ball moves toward the cage 26. The cage 26 catches the ball and retains the ball inside the nipple. The cage has openings to allow the water to flow around the ball and enter the tank 12. When the hot water is turned off, the ball 28 floats upwardly back towards and into engagement with the seat 24 trapping heat below it.

A similar hot water heat trap assembly 40 is provided on the hot water outlet pipe 16. The heat trap assembly 40 includes a nipple 42, a seat 44, a cage 46, and a ball 48. The nipple 42 is received in the inlet 50 of the hot water outlet pipe 16 and in the outlet 52 of the tank 12. The seat 44 and the cage 46 are of the same or similar construction of the seat 24 and the cage 26 of the cold water heat trap assembly 20. In the hot water heat trap assembly 40, the seat 44 and the cage 46 are disposed on opposite ends of the heat trap assembly as compared to the cold water heat trap assembly 20. The ball 48 of the hot water heat trap assembly 40 has a specific gravity greater than 1.0. Accordingly, when the hot water exits the tank 12 into the nipple 42, the ball 48 is dislodged from the seat 44 and retained by the cage 46. The cage has openings to allow water to pass around the ball and through the nipple. When the hot water is turned off in the household, no hot water is flowing through the nipple 42 and the hot water outlet pipe 16 so that the ball 48 sinks toward and into engagement with the seat 44 trapping heat below.

The problem with the above-mentioned energy saving device involves "chatter" of the balls 28 and 48 inside the nipples 22 and 42. Because the diameter of the nipple required to allow the ball to float freely inside the nipple and the influence of water flowing through the nipple, the balls tend to rotate at a relatively high speed. The high speed rotation of the balls allows the ball to contact the nipple and "chatter" making an audible sound that is noticeable to those standing near the water heater. To some consumers, this is considered objectionable, although it does not represent a defect in the heat trap. Accordingly, it is desirable to provide a heat trap assembly that provides the same or better energy efficiency of the prior art heat traps while also eliminating the "chatter" that accompanies such heat trap assemblies.

SUMMARY OF THE INVENTION

A heat trap assembly for a hot water tank includes a housing having a fluid inlet and a fluid outlet and a sealing member disposed in the housing. The sealing member includes a tail portion and a portion that is dimensioned to at least substantially cover the inlet of the housing to prevent loss of heat through the fluid inlet when no fluid is running through the inlet and allow fluid to pass around the sealing member when fluid is flowing through the outlet.

According to another aspect of the invention a heat trap assembly for a hot water tank includes a cage, a seat and a sealing member. The cage includes an opening that defines a fluid outlet. The seat attaches to the cage and includes an opening that defines a fluid inlet. The sealing member includes a post. The sealing member is trapped between the opening that defines the fluid outlet and the opening that defines the fluid inlet.

According to yet another aspect of the invention, a heat trap assembly for a hot water tank includes a housing and a sealing member disposed in the housing. The sealing member includes a first portion that is adapted to restrict rotational movement of the sealing member in at least two perpendicular axes. The sealing member includes a second portion that is adapted to restrict rotational movement in a third axis perpendicular to both of the at least two perpendicular axes.

DETAILED DESCRIPTION OF THE INVENTION

It is to be understood that the specific devices and processes illustrated in the attached drawings, and described in the following specification are simply exemplary embodiments of the inventive concepts. Hence, specific examples and characteristics relating to the embodiments disclosed herein are not to be considered as limiting.

Furthermore, for ease of illustration and comprehension the orientation of the heat trap assemblies is disclosed for a hot water heater assembly having inlet and outlet pipes located at the top to the heater. The heat trap assembly can also be used on hot water heater assemblies where the water enters at an alternative location, however the orientation and configuration of the components may need to be altered. The flow of the water through the heat trap assembly will control the location of certain components and the description that follows should not be deemed limiting as to certain hot water or cold water heat trap assemblies.

Figure 3:
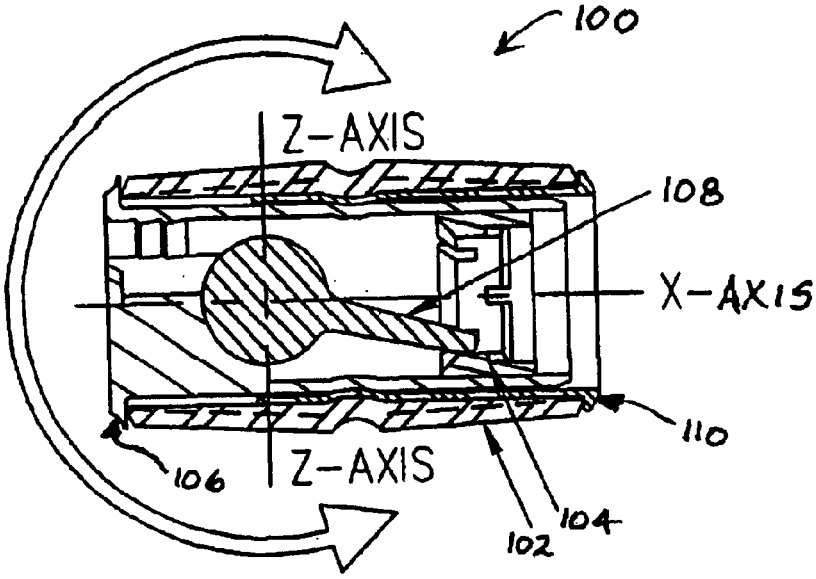
FIG. 3 is a side cross-section view of a heat trap assembly according to the present invention.

Referring to FIG. 3, a heat trap assembly 100 includes a nipple 102, a seat 104, a cage 106, a sealing member 108, and an insert 110. The seat, cage, sealing member and insert of the heat trap assembly are made of a durable material, which in the preferred embodiment is plastic. The nipple is also made of a durable material, which in the preferred embodiment is metal.

Figure 1:
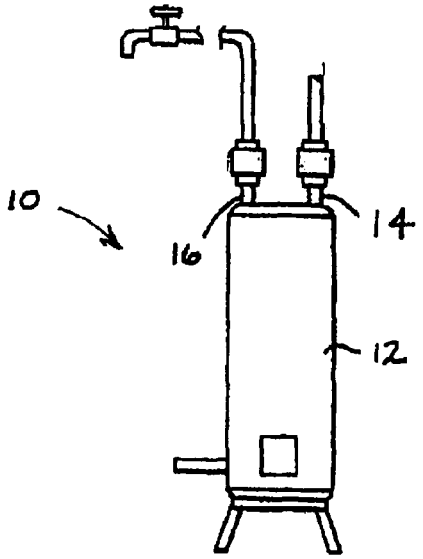
FIG. 1 PRIOR ART
FIG. 1 is a schematic view of a prior art hot water heater assembly.
Figure 2:
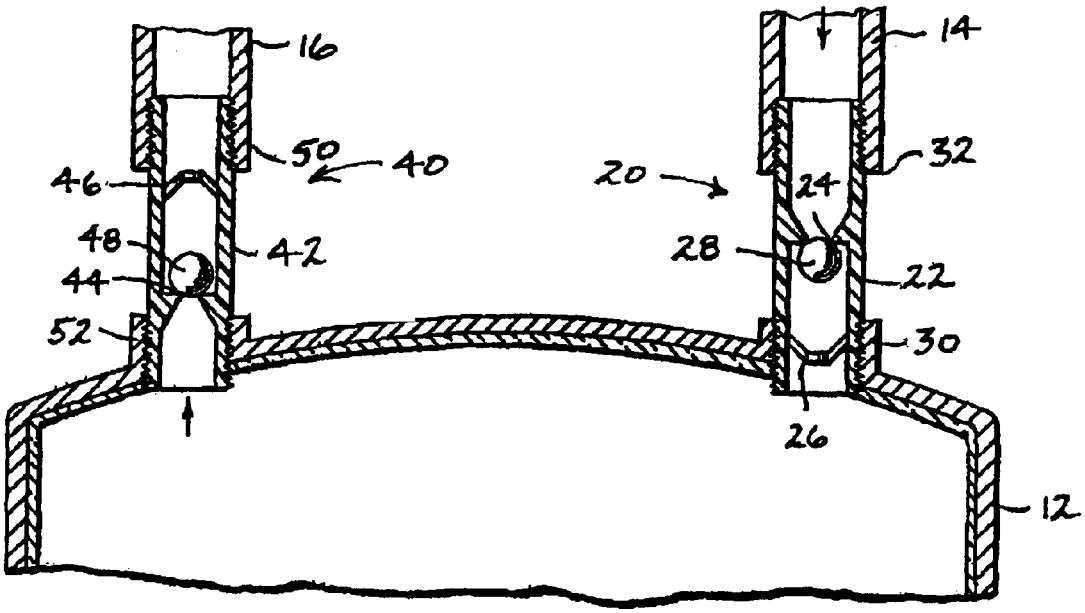
FIG. 2 PRIOR ART
FIG. 2 is a sectional view with parts in elevation of the upper portion of the hot water heater assembly of FIG. 1 disclosing a prior art heat trap assembly.

The nipple 102 receives the seat, the cage, the sealing member, and the insert. In an alternative embodiment, the nipple can include at least one of the seat, the cage or the insert. In the preferred embodiment, the nipple includes threads (not shown) to attach to the pipes 14 and 16 (FIGS. 1 and 2) and the tank inlet 30 and the tank outlet 52 (FIG. 2). The diameter of the nipple 102 is slightly larger than the diameter of the sealing member 108.

Figure 5:
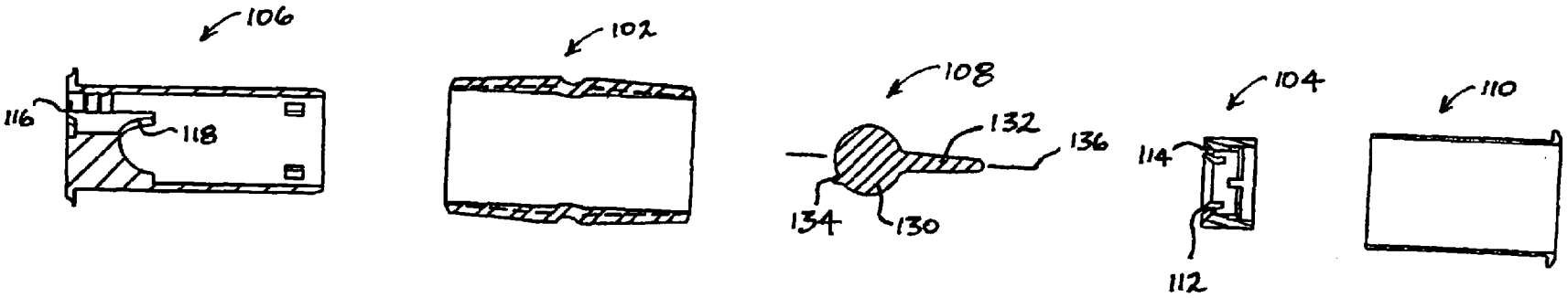
FIG. 5 is an exploded cross section view of the heat trap assembly of FIG. 3.

Referring to FIG. 5, the seat 104 defines an opening 112 having a diameter smaller than the sealing member 108. The opening 112 can define a fluid inlet for the water that will flow through the assembly. The seat also includes a beveled ledge 114 surrounding the opening. The beveled ledge allows a more secure fit for the sealing member 108 when it is seated on the seat. In a cold water heat trap assembly the seat is situated at the top of the heat trap assembly. In a hot water heat trap assembly the seat is situated at the bottom of the heat trap assembly. In the preferred embodiment, the seat 104 attaches to the cage 106. The seat in combination with the cage can provide a housing for the sealing member 108. The seat is shown as a separate component from the nipple 102, the cage 106 and the insert 110, however it is contemplated that the seat could be a unitary piece with any of the aforementioned components.

Figure 4:
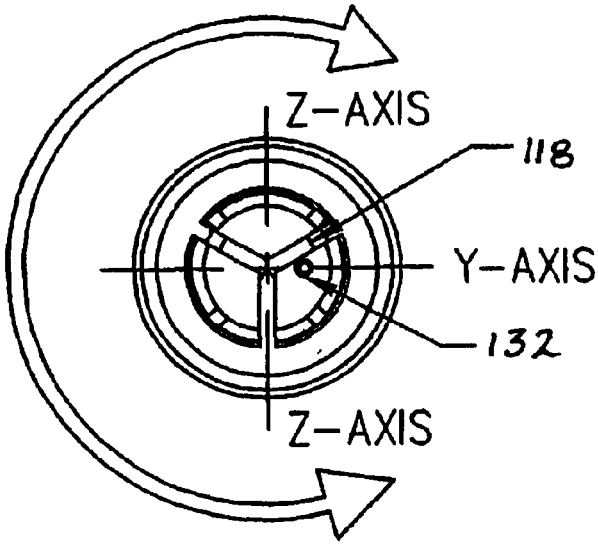
FIG. 4 is an end view of the heat trap assembly of FIG. 3 taken from the left side of FIG. 3.

The cage 106 defines an opening 116 having a diameter larger than the sealing member 108. The opening 116 can define a fluid outlet for the assembly. The cage includes trapping members or ribs 118 that interrupt the opening 116. Each rib 118 includes a curved surface to catch the sealing member 108. As seen in FIG. 4, the ribs 118 are situated 120° apart from one another giving the ribs a Y configuration in cross-section. The exact number, shape and orientation of the ribs is not critical. The cage need only retain the sealing member while water is flowing through the assembly, and also allow water to flow around the sealing member and through the opening 116. The distance between the ribs of the cage and the ledge of the seat is limited by the length of the sealing member 108, which will be described in greater detail below. The cage is depicted as a separate piece, however it could be of unitary construction with the nipple, the seat and/or the insert. In a cold water heat trap assembly the cage is situated at the bottom of the heat trap assembly. In a hot water heat trap assembly the cage is situated at the top of the heat trap assembly.

The sealing member 108 includes a spherical portion 130, a tail portion 132, and a post or stud 134. The sealing member is designed so that it will rotate very little or not at all when water passes through the assembly. In a hot water heat trap assembly, the sealing member has a specific gravity greater than 1.0. In a cold water heat trap assembly the sealing member has a specific gravity less than 1.0. The spherical portion 130 of the sealing member has a diameter less than the diameter of both the nipple 102 and the cage opening 116. The spherical portion 130 of the non-rotating sealing member has a diameter larger than the diameter of the opening 112 of the seat 104. In lieu of having a spherical configuration, the spherical portion could take another configuration. An alternative configuration would allow the sealing member 108 to at least substantially cover the inlet or the outlet of the assembly 100 so that heat is not lost from the hot water tank into the water held in the attached piping.

Figure 9:
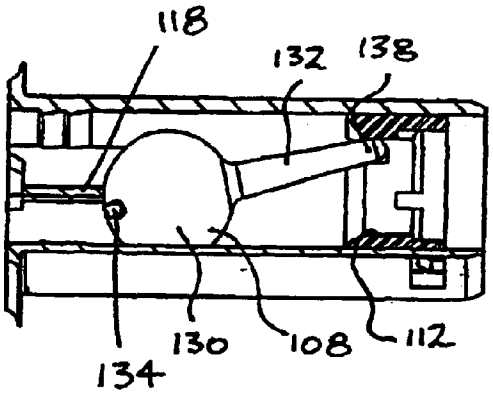
FIG. 9 is a side cross-section view of a portion of the heat trap assembly of FIG. 3 with water flowing through the assembly.
Figure 6:
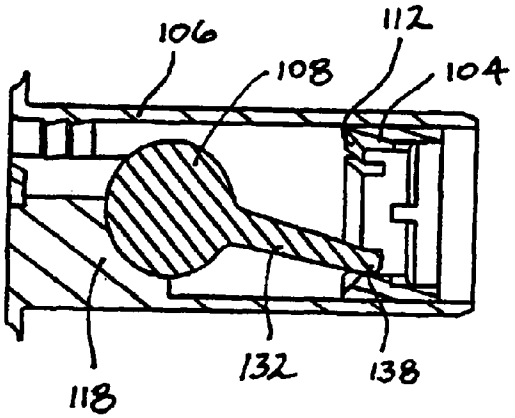
FIG. 6 is a side cross-section of a portion of the heat trap assembly of FIG. 3 with water flowing through the assembly.

The tail portion 132 extends from the spherical portion 130 of the sealing member 108. The tail portion 132 is frusto-conical in configuration tapering away from the spherical portion 130. Alternatively, the tail portion can be cylindrical, or another suitable shape. As seen in FIGS. 6 and 9, the length of the tail portion is such that an end 138 of the tail portion 132 of the sealing member 108 can still rest against the seat 104 when the sealing member 108 contacts the ribs 118 of the cage 106.

The post 134 is positioned slightly off-center from a central axis 136 of the sealing member 108. The post is a protruding stud disposed substantially opposite the tail portion 132. The length of the post is such that the post will catch or engage one of the ribs 118 when water is flowing through the nipple 102 as seen in FIGS. 4 and 9.

Referring to FIG. 3, the insert 110 is interposed between the nipple 102 and the cage 106. The insert 110 retains the cage in place inside the nipple with a resilient friction fit.

Figure 7:
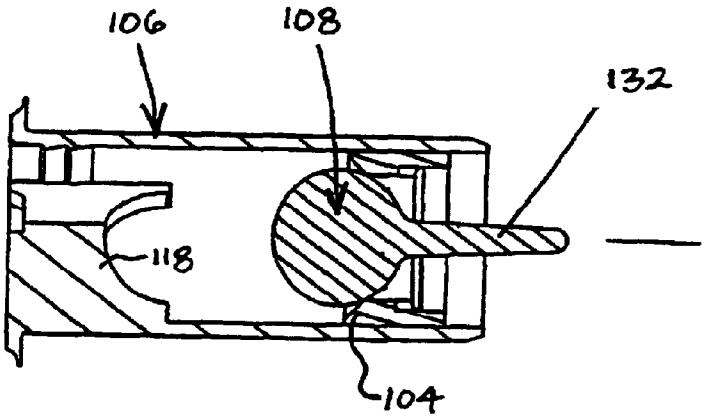
FIG. 7 is a side cross-section view of a portion of the heat trap assembly of FIG. 3 with no water flowing through the assembly.
Figure 8:
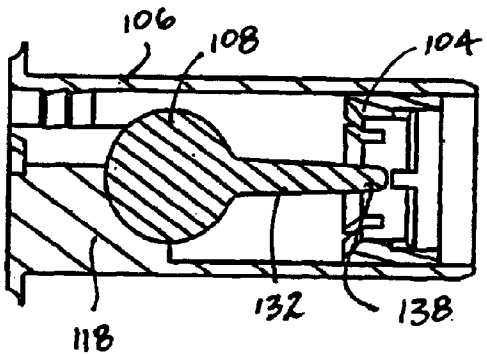
FIG. 8 is a side cross-section view of a portion of the heat trap assembly of FIG. 3 with water flowing through the assembly.

Referring to FIGS. 6–9, the sealing member is trapped between the opening 112 of the seat 104 and the opening 116 of the cage 106 by the beveled ledge 114 and the ribs 118. Referring now to FIG. 7, with no water flowing through the assembly 10, the sealing member 108 is seated on the seat 104, thus trapping heat below. Referring now to FIG. 6, as the water enters the assembly 100 the sealing member 108 moves towards the ribs 118 of the cage 106. As seen in FIGS. 4, 8 and 9, the ribs 118 of the cage 106 retain the sealing member as water flows through the assembly. The tail portion 132 of the sealing member does not exit the opening 112 of the seat when the sealing member contacts the ribs of the cage.

The sealing member 108 is restricted from rotation and inhibited from rattling against the cage 106 when water is flowing through the assembly causing an unwanted "chatter". As seen in FIG. 3, the tail portion 132 of the sealing member 108 restricts rotation about the Y-axis and the Z-axis. Rotation about the Y-axis and the Z-axis maybe further restricted by the end 138 of the tail portion 132 resting against the seat 104. Rotation about the X-axis is restricted by the post 134 engaging the rib 118 of the cage 106. Thus, the tadpole shape of the sealing member 108 limits rotational movement of the sealing member in the Y and Z axes. The protruding post 134 of the sealing member 108 contacting the rib 118 restricts rotation about the X-axis.

A heat trap assembly having the desired energy efficiency is provided without having the accompanying unwanted "chatter" as found in the prior art. The invention has been described with reference to the preferred embodiment. Obviously, modifications and alterations will occur to others upon reading and understanding the preceding detailed description. It is intended that the invention described be construed to include all reasonable modifications and alterations that come within the scope of the appended claims.

What is claimed is:

1. A heat trap assembly for a hot water tank comprising:

a housing having a fluid inlet and a fluid outlet; and a sealing member disposed in said housing, wherein the sealing member includes a tail portion, a post disposed substantially opposite the tail portion and a portion that is dimensioned to at least substantially cover the inlet of said housing to prevent loss of heat through the fluid inlet when no fluid is running through the inlet and allow fluid to pass around the sealing member when fluid is flowing through the outlet.

2. The assembly of claim 1, wherein said sealing member includes a substantially spherical portion attached to the tail portion, the spherical portion dimensioned to at least substantially cover the inlet of said housing to prevent loss of heat through the fluid inlet when no fluid is running through the inlet and allow fluid to pass around the sealing member when fluid is flowing through the outlet.

3. The assembly of claim 2, wherein the tail portion is aligned with a central axis of the spherical portion.

4. The assembly of claim 1, wherein the post is positioned slightly off center of a central axis of the tail portion.

5. The assembly of claim 1, further comprising a nipple adapted to attach to an associated inlet or outlet pipe of a hot water tank, wherein the housing is disposed in said nipple.

6. A heat trap assembly for a hot water tank comprising:

a cage having an opening that defines a fluid outlet;

a seat opposite to said opening that defines the fluid outlet, said seat including an opening that defines a fluid inlet; and a sealing member including a post, said sealing member trapped between the opening that defines the fluid outlet and the opening that defines the fluid inlet.

7. The assembly of claim 6, wherein the cage includes a rib that interrupts the opening that defines the fluid outlet.

8. The assembly of claim 7, wherein the post is adapted to engage the rib when fluid is flowing through the fluid outlet.

9. The assembly of claim 7, wherein the rib includes a curved surface.

10. The assembly of claim 6, wherein the seat includes a beveled edge adjacent the opening that defines the fluid inlet and said sealing member includes a spherical portion dimensioned to seat against the beveled edge to prevent heat loss through the opening that defines the fluid inlet.

11. The assembly of claim 6, wherein the sealing member includes a tail portion.

12. The assembly of claim 11, wherein the post is positioned off center of an axis running through the tail portion.

13. The assembly of claim 6, wherein said cage includes a trapping member that traps said sealing member inside the assembly when fluid is flowing through the assembly, and wherein at least a portion of the tail portion of the sealing member remains disposed inside the opening that defines the fluid inlet when said sealing member contacts the trapping member.

14. A heat trap assembly for a hot water tank including;

a housing having a fluid inlet and a fluid outlet;

a sealing member disposed in said housing and including a first portion that is adapted to restrict rotational movement of said sealing member in at least one of two perpendicular axes and a second portion that is adapted to restrict rotational movement in a third axis perpendicular to both of the at least two perpendicular axes.

15. The heat trap assembly of claim 14, wherein the first portion of said sealing member is adapted to restrict rotational movement in each of the at least two perpendicular axes.

16. The heat trap assembly of claim 14, wherein said sealing member includes a substantially spherical portion and the first portion extends from the substantially spherical portion in a tail-like configuration.

17. The heat trap assembly of claim 14, wherein said sealing member includes a substantially spherical portion and the second portion comprises a post extending from the substantially spherical portion.

18. The heat trap assembly of claim 17, further comprising a cage positioned in said housing, wherein the post engages a portion of the cage when fluid is running through the assembly.

19. The heat trap assembly of claim 14, further comprising a nipple adapted to attach to an associated hot water tank, wherein said housing is received in said nipple.

20. A heat trap assembly for a hot water tank comprising:

a cage having an opening that defines a fluid outlet;

a seat opposite to said opening that defines the fluid outlet, said seat including an opening that defines a fluid inlet; and a sealing member including a tail portion, said sealing member trapped between the opening the defines the fluid outlet and the opening that defines the fluid inlet.

* * * * *